US006220396B1

(12) United States Patent
Heath, III

(10) Patent No.: US 6,220,396 B1
(45) Date of Patent: Apr. 24, 2001

(54) DOOR RESTRICTOR APPARATUS FOR ELEVATORS

(75) Inventor: Ernest A. Heath, III, Olive Branch, MS (US)

(73) Assignee: Thyssen Dover Elevator, Horn Lake, MS (US)

( * ) Notice: Subject to any disclaimer, the term of this patent is extended or adjusted under 35 U.S.C. 154(b) by 0 days.

(21) Appl. No.: 09/523,564

(22) Filed: Mar. 10, 2000

(51) Int. Cl.[7] ..... B66B 13/00
(52) U.S. Cl. ..... 187/335; 187/319; 49/120
(58) Field of Search ..... 187/307, 308, 187/309, 310, 318, 319, 331, 335; 49/116, 120, 122, 279, 366, 370, 409

(56) References Cited

U.S. PATENT DOCUMENTS

| | | | | |
|---|---|---|---|---|
| 1,326,440 | * | 12/1919 | Chaudoir | 187/330 |
| 2,899,021 | * | 11/1959 | O'Grady | 187/339 |
| 3,721,319 | * | 3/1973 | Hall et al. | 187/339 |
| 4,313,525 | * | 2/1982 | McDonald | 187/335 |
| 4,423,799 | * | 1/1984 | Glaser et al. | 187/335 |
| 4,457,405 | * | 7/1984 | Johns | 187/319 |
| 4,926,974 | * | 5/1990 | Morris et al. | 187/319 |
| 4,926,975 | * | 5/1990 | Morris | 187/335 |
| 5,129,486 | * | 7/1992 | Steacy et al. | 187/319 |
| 5,377,785 | * | 1/1995 | Pearson | 187/335 |
| 5,636,715 | * | 6/1997 | Hayashi et al. | 187/330 |
| 5,690,188 | * | 11/1997 | Takakusaki et al. | 187/319 |

FOREIGN PATENT DOCUMENTS

| | | | | |
|---|---|---|---|---|
| 401247389 | * | 10/1989 | (JP) | 187/335 |
| 404164797 | * | 6/1992 | (JP) | 187/319 |
| 405132275 | * | 5/1993 | (JP) | 187/331 |

* cited by examiner

*Primary Examiner*—Robert P. Olszewski
*Assistant Examiner*—Paul T. Chin
(74) *Attorney, Agent, or Firm*—White & Case LLP

(57) ABSTRACT

The present invention provides a door restrictor apparatus for locking and preventing a sliding door on an elevator car from unauthorized opening. The door restrictor apparatus includes a locking lug mounted on the elevator car, an actuating mechanism having an actuating surface that moves toward and away from a surface on the car door, and a pivotable hook, having an axis of rotation perpendicular to the direction of the door movement is mounted on the door. The hook has a beak end that alternatively passes by or engages the locking lug. The movement of the actuating surface is coupled to the rotation of the pivotable hook by a crank and push rod assembly so that the motion of the actuating surface toward or away from the surface of the car door causes the hook to rotate and vice-versa. A means for biasing the restrictor apparatus is provided to urge the actuating surface to move away from the surface of the door and to urge the pivotable hook to rotate in a first direction. The restrictor apparatus has a closed position wherein the hook is rotated to a first position and the actuating surface is at a corresponding first position relative to the door surface when the sliding door is closed. As the sliding door begins to open, the restrictor apparatus moves into an unlocked position if the car is at a landing or a locked position if the car is not at a landing. In the unlocked position, when the sliding door begins to open, the hook rotates to a second position where the beak will pass by the lug as the door opens and wherein the actuating surface is at a corresponding second position. In the locked position, when the sliding door begins to open, the hook rotates to a third position where the beak will engage and lock against the lug as the door opens preventing the door from opening any further and wherein the actuating surface is at a corresponding locked position.

10 Claims, 11 Drawing Sheets

DOOR RESTRICTOR APPARATUS FOR ELEVATORS

BACKGROUND OF THE INVENTION

1. Field of the Invention

The present invention relates generally to door interlock systems used in elevators. In particular, the invention concerns a door restrictor apparatus for an elevator door apparatus that prevents the elevator doors from opening when the elevator cab is between landings and not aligned with the hatchway doors of the system.

2. Description of the Related Art

In conventional elevators, an elevator car typically includes a motor to open and close the car door or doors. When the car is stopped at a landing, a clutch mechanism on the car door engages rollers on the hatchway door or doors so that the hatchway door opens and closes in unison with the car door.

One of the safety devices commonly provided on modern passenger elevators is a mechanism to prevent the car doors from opening when the car is not within a certain distance of the landing. This feature is desirable in the case of a car that has become stuck between floors, because it prevents passengers from prying open the doors in an attempt to exit the car, which could result in injury. Such devices also prevent the door(s) from opening in the event that the door motor, due to a malfunction, were to attempt to open the doors when the car is not at a landing.

U.S. Pat. No. 4,313,525, to McDonald, discloses a car door safety interlock system. In that system, a power operated sliding door of an elevator car is provided with a mechanical safety interlock which permits the car door to be moved more than a critical distance from its closed position only when the car is in a landing zone. A pivoted interlock hook on the car door has a normal position in which it engages an interlock lug on the car frame when the door moves the critical distance from closed position. A movable element on the car door is driven to move the hook to a clearance position relative to the interlock lug. Drive of the movable element occurs when it contacts an inter-engaging member on the hatch door as the car door first starts to move from closed position in a landing zone.

It is an object of the present invention to provide an improved apparatus for preventing an elevator car door from opening when the car is not within a predetermined distance of a landing.

SUMMARY OF THE INVENTION

The present invention provides a novel design of a door restrictor apparatus for locking and preventing a sliding door on an elevator car from unauthorized opening when the car is not at a landing area. In accordance with the present invention, a locking lug is mounted on the elevator car. An actuating mechanism having an actuating surface that moves toward and away from a surface on the car door is disposed on the surface of the car door. A pivotable hook, having an axis of rotation perpendicular to the direction of the door movement is also mounted on the door. The hook has a beak end that alternatively passes by or engages the locking lug depending upon the rotational position of the hook. A crank and push rod assembly disposed on the door is connected to the actuating mechanism and to the hook and couples the movement and position of the actuating surface to the rotation and position of the hook and vice-versa. The restrictor apparatus also includes a means for biasing the restrictor to urge the actuating surface to move away from the door and to urge the hook to rotate in a first direction (e.g. clockwise). In a preferred embodiment, the means for biasing is at least one leaf spring mounted to the actuating mechanism.

The restrictor apparatus of the invention has three positions: (i) a closed position; (ii) an unlocked position; and (iii) a locked position. In the closed position, the elevator car doors are closed, the hook is oriented at a first position and the actuating surface is oriented at a corresponding first position relative to the door surface. When the elevator doors are closed the beak end of the hook engages a fixed member mounted on the car and the hook is thereby rotated to the first position and the restrictor apparatus is thus placed in the closed position. In a preferred embodiment, the fixed member is a hook roller mounted on the car and having an axis of rotation that is parallel to the axis of rotation of the hook.

As the sliding door(s) begins to open, the beak end moves off the fixed member. Because of the bias in the apparatus, the hook begins to rotate and the actuating surface begins to move away from the surface of the door. At this point, the restrictor apparatus will move into the unlocked or locked position depending on whether the car is at a landing or is between landings. In the unlocked position, when the door opens while the car is at a landing, the hook will rotate and stop at a second position where the beak will pass by the lug as the door opens and wherein the actuating surface is at a corresponding second position. In the locked position, when the door opens while the car is not at a landing, the hook will rotate and stop at a third position where the beak will engage the lug and wherein the actuating surface is at a corresponding third position.

The crank and push rod assembly has a crank body that rotates about an axis. A first arm extends from the crank body in a direction generally perpendicular to the axis of rotation. A second arm extends from the crank body also in a direction generally perpendicular to the axis of rotation. A slide bushing is seated on the first arm and has a cylindrical bore. The slide bushing is capable of rotating about and sliding along the first arm. The slide bushing also has an elongated slot with a length dimension parallel to its cylindrical axis and has a width dimension perpendicular to the length dimension that is shorter then the length dimension.

In one embodiment, the present invention is employed in an elevator system having an elevator shaft, a plurality of landings, and hatchway doors at each landing. Each hatchway door has one or more hatchway rollers for engaging a clutch that is mounted on the outside of the car door. The clutch and hatchway rollers, when engaged, cause the hatchway door to open in unison with the car door. As discussed below, the hatchway door rollers also can be used to engage the actuating surface of the actuating mechanism.

In operation of this embodiment, the present invention functions as follows. When the car door is closed, the hook is at a first position and the actuating surface is at a corresponding first position. The apparatus is calibrated such that when the restrictor is in the closed position the actuating surface at the corresponding first position will not hit any protrusions, such as the hatchway rollers when the car is traveling between floors. When the car is at landing area (i.e., within a predetermined distance of a landing) and the door begins to move from the closed position to the open position, the hook begins to rotate in the first direction but stops rotating at the second position. The hook, which is coupled with the actuating surface, stops rotating because the actuating surface contacts the hatchway door rollers. When the hook stops in the second position the restrictor apparatus is in the unlocked position. When the restrictor apparatus is unlocked, the hook passes by the lug and the elevator door may freely slide open. If, however, the car is not at a landing area as the car door moves from the closed position toward the open position, the hook rotates in the first direction to the third position, at which the beak end will engage and lock against the lug and prevent the door from opening farther. When the car is not at a landing, the hook will not stop at the second position because the actuating surface is free to move away from the surface of the door and is not stopped by the hatchway door rollers.

For a better understanding of the invention, reference is made to the following detailed description of a preferred embodiment, taken in conjunction with the drawings accompanying the application.

BRIEF DESCRIPTION OF THE SEVERAL VIEWS OF THE DRAWING

FIG. 2 shows a pair of conventional rollers that are disposed on the hatchway door (not shown) at the landing.

FIG. 3 also shows the car doors partially opened and the door restrictor apparatus engaged in the locked position.

FIG. 5 shows a pair of conventional rollers on the hatch door (not shown) disposed above but not in contact with the actuating mechanism of the door restrictor apparatus.

FIG. 6 shows a pair of conventional rollers on the hatch door (not shown) disposed above and pressingly contacting mechanism of the door restrictor.

DETAILED DESCRIPTION OF THE INVENTION

Figure 1:
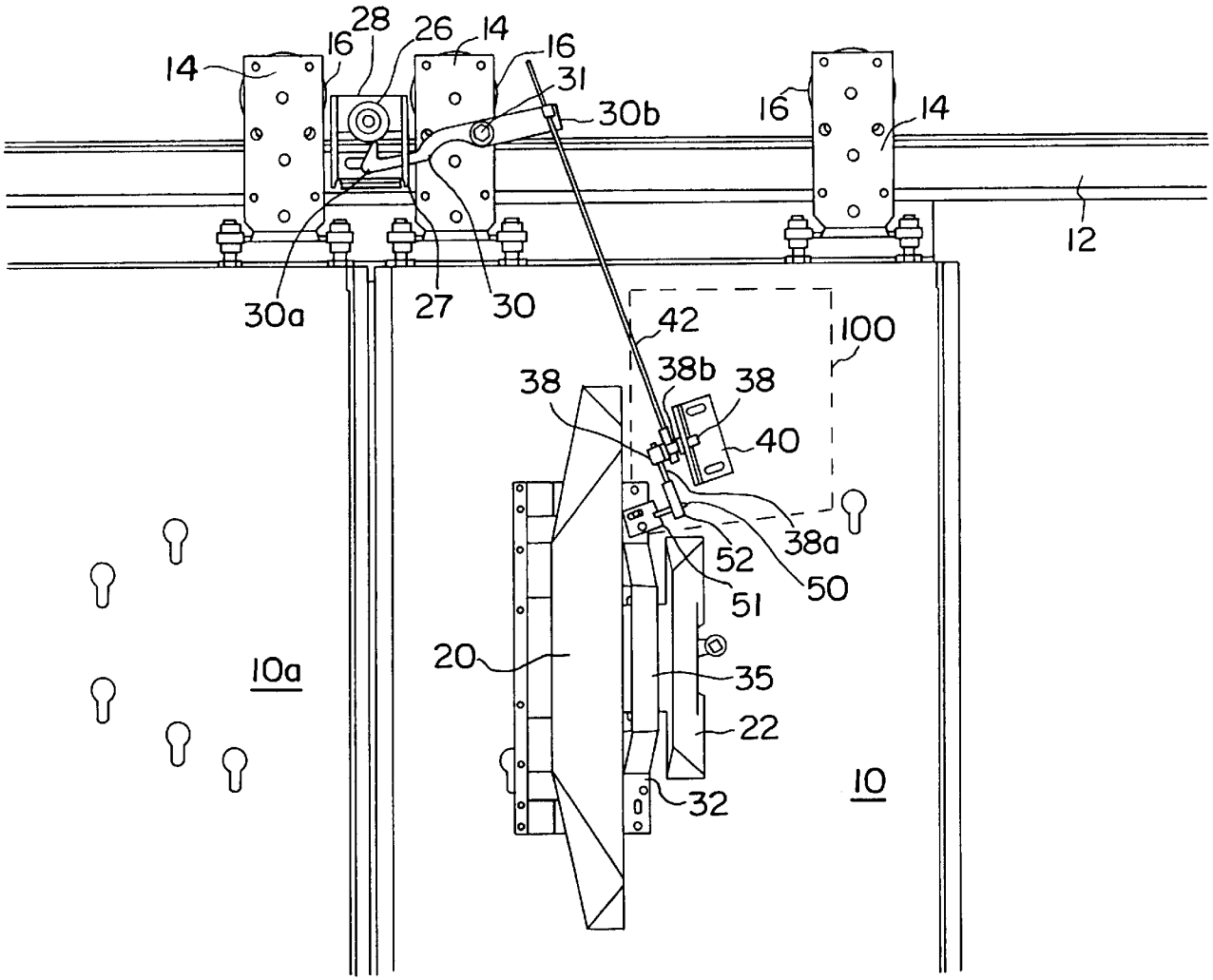
FIG. 1 is a front view of an elevator car door, looking from outside of the car, showing the elevator doors and restrictor apparatus according to the invention in the closed position.

Referring to the figures, wherein like reference numerals designate like parts, FIG. 1 shows an elevator door arrangement and the restrictor apparatus of the invention. In FIG. 1, the doors and restrictor apparatus are shown in their closed position. The doors 10 and 10*a* are suspended from an overhead rail 12, which is part of the car body, by hangers 14 containing wheels 16, so that the doors 10, 10*a* can move in a longitudinal direction between open and closed positions. The doors 10, 10*a* are coupled to one another, for example by a continuous cable, for simultaneous movement in opposite directions.

The doors are automatically opened and closed using a motor and drive mechanism (not shown), and a processor which controls the drive motor responsive to its own programming and sensors in the doorway which detect obstructions. Such arrangements are well known in the art.

The door 10 includes a clutch mechanism comprised of vanes 20 and 22. These vanes 20 and 22 are designed to engage a pair of hatchway door rollers 24, 25 (shown in FIGS. 2, 3, 5, and 6) when the car is at a landing area (i.e., within a certain distance of the landing, which is determined by the size of the components in the system). Such clutch mechanisms are well known, and thus need not be described further herein. Any suitable clutch mechanism may be used with the present invention.

The present invention is directed to an interlocking door restrictor apparatus for locking and preventing the elevator car doors from opening when the car is not at a landing. Referring to FIG. 1, a protrusion, such as roller 26, is mounted on the top of the car body with a bracket 28 fixed to the top rail 12. The axis of the rotation of the roller 26 is oriented to be perpendicular to the direction of the door movement. The bracket 28 also contains a lug 27 for engaging a beak end 30*a* of a hook member 30. The hook member 30 is pivotally mounted on the door with a pivot bolt 31 and has an axis of rotation perpendicular to direction of motion of the door 10. The hook member 30 also has a second end 30*b* for pivotally engaging an upper end of a push rod 42, which is part of a crank and push rod assembly 100 (outlined with dashed lines in FIG. 1, and discussed in greater detail below).

Figure 2:
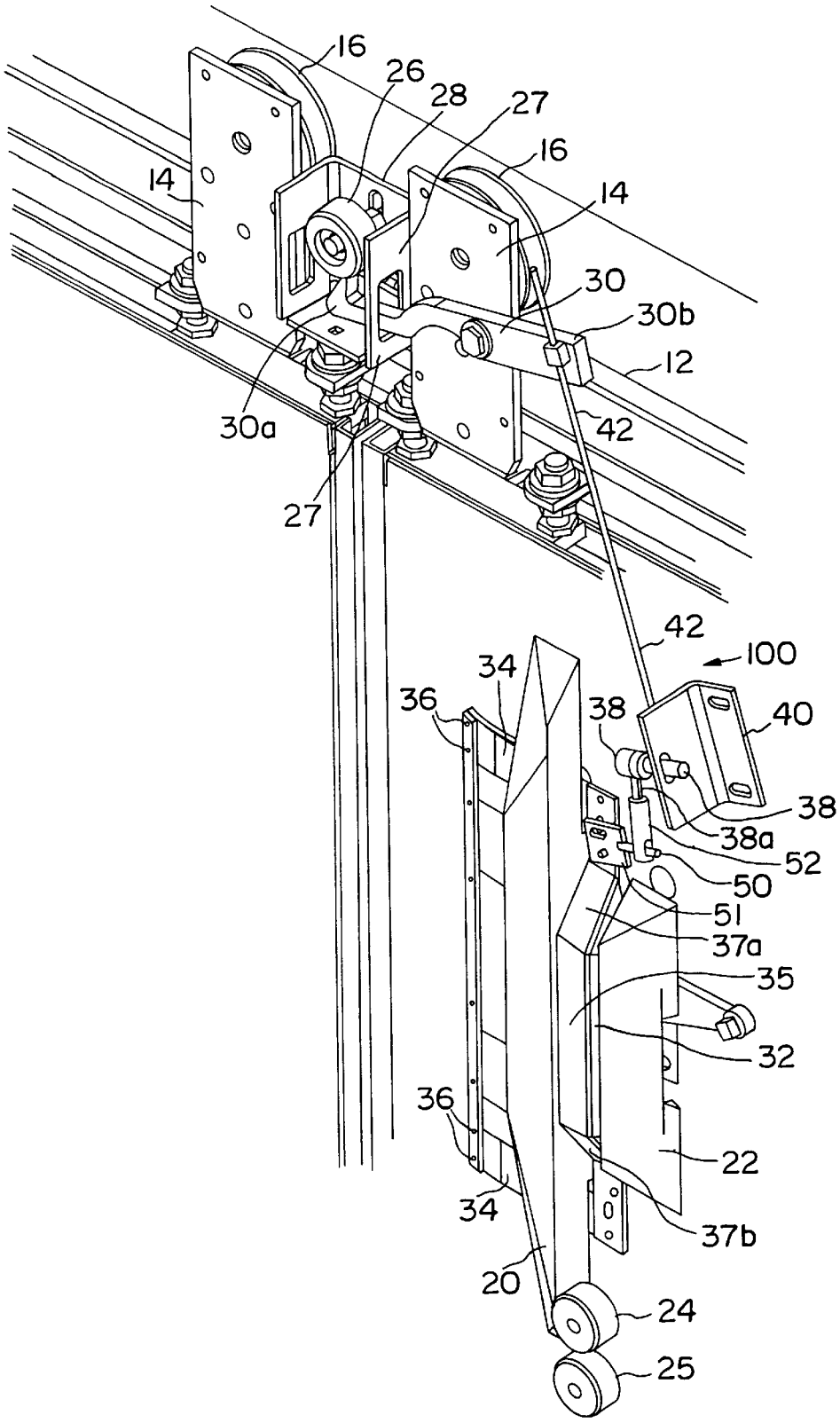
FIG. 2 is a perspective view of the door restrictor apparatus of the invention in the closed position as the elevator car is approaching a landing but still above the hatchway door zone.
Figure 3:
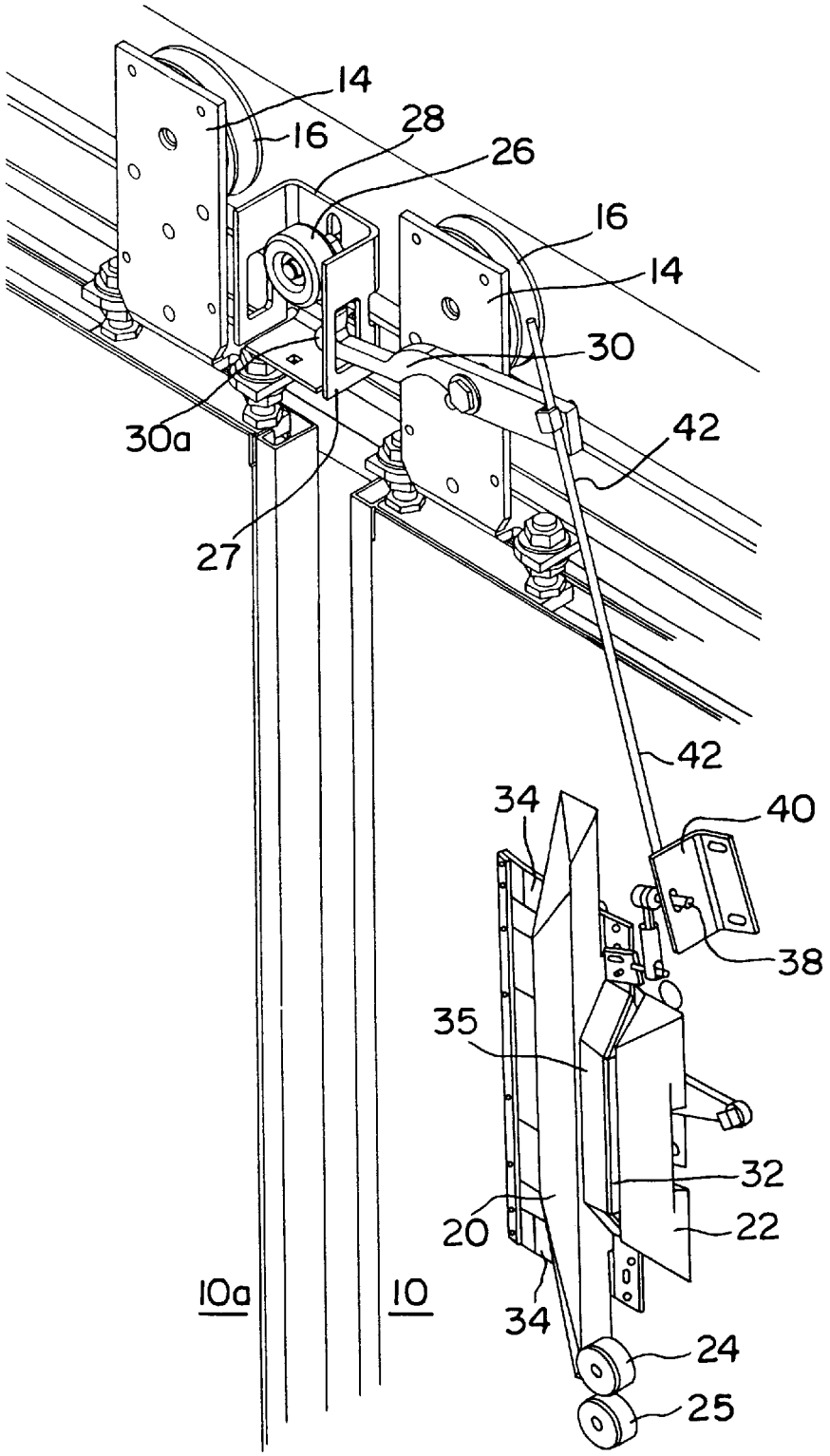
FIG. 3 is a perspective view of the door restrictor apparatus in the invention, with a car above a landing and consequently outside the hatch door zone.
Figure 4:
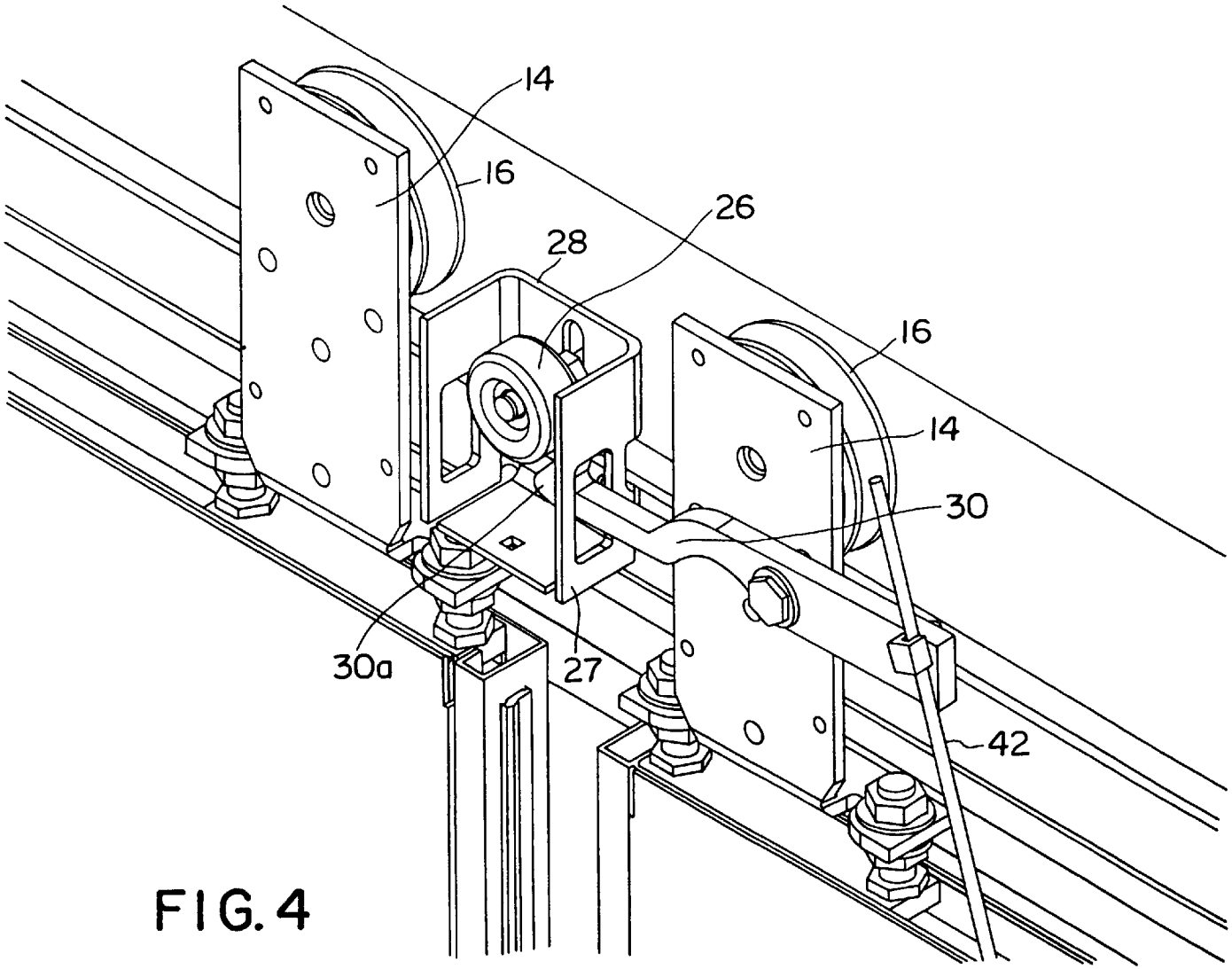
FIG. 4 is an enlarged view of the upper portion of the apparatus shown in FIG. 3.

Referring now to FIG. 2, the door restrictor apparatus also includes an actuating mechanism 32 positioned between the clutch vanes 20 and 22 and mounted on the ends of two leaf springs 34. The opposite ends of the springs 34 are secured to the car door 10, for example with screws 36. In this manner, the actuating mechanism 32 is cantilevered relative to the car door 10 and can pivot about a vertical axis against the force of the springs 34. The actuating mechanism 32 includes an actuating surface 35 that is vertically disposed between a pair of opposed ramp portions 37*a* and 37*b*, which are angled toward the car door 10. The force of springs 34 generally tends to urge the actuating surface 35 and associated ramp portions 37*a* and 37*b* to move away from the surface of the door 10.

The actuating mechanism 32 is connected to the crank and push rod assembly 101 at plate 51. As stated above, the leaf springs 34 bias the actuating mechanism 32 to move away from the car door 10. The crank and push rod assembly 100 couples the movement of the actuating mechanism 32 to the rotation of the hook 30. Through the coupling provided by the crank and push rod assembly 100, the bias that urges the actuating surface 35 to move away from the door 10*a* is translated into a rotational bias that urges the hook member 30 to rotate in a clockwise direction. Any crank and push rod assembly capable of coupling the movement of the actuating surface to the rotational movement of the hook 30 will be suitable.

Figure 9:
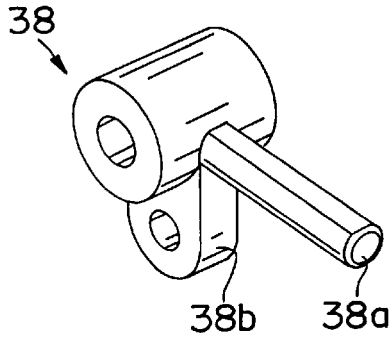
FIG. 9 is an enlarged perspective view of crank element 38 depicted in the figures.
Figure 10:
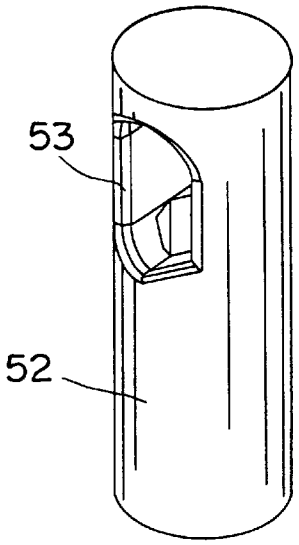
FIG. 10 is an enlarged perspective view of slide bushing element 52 depicted in the figures.
Figure 11:
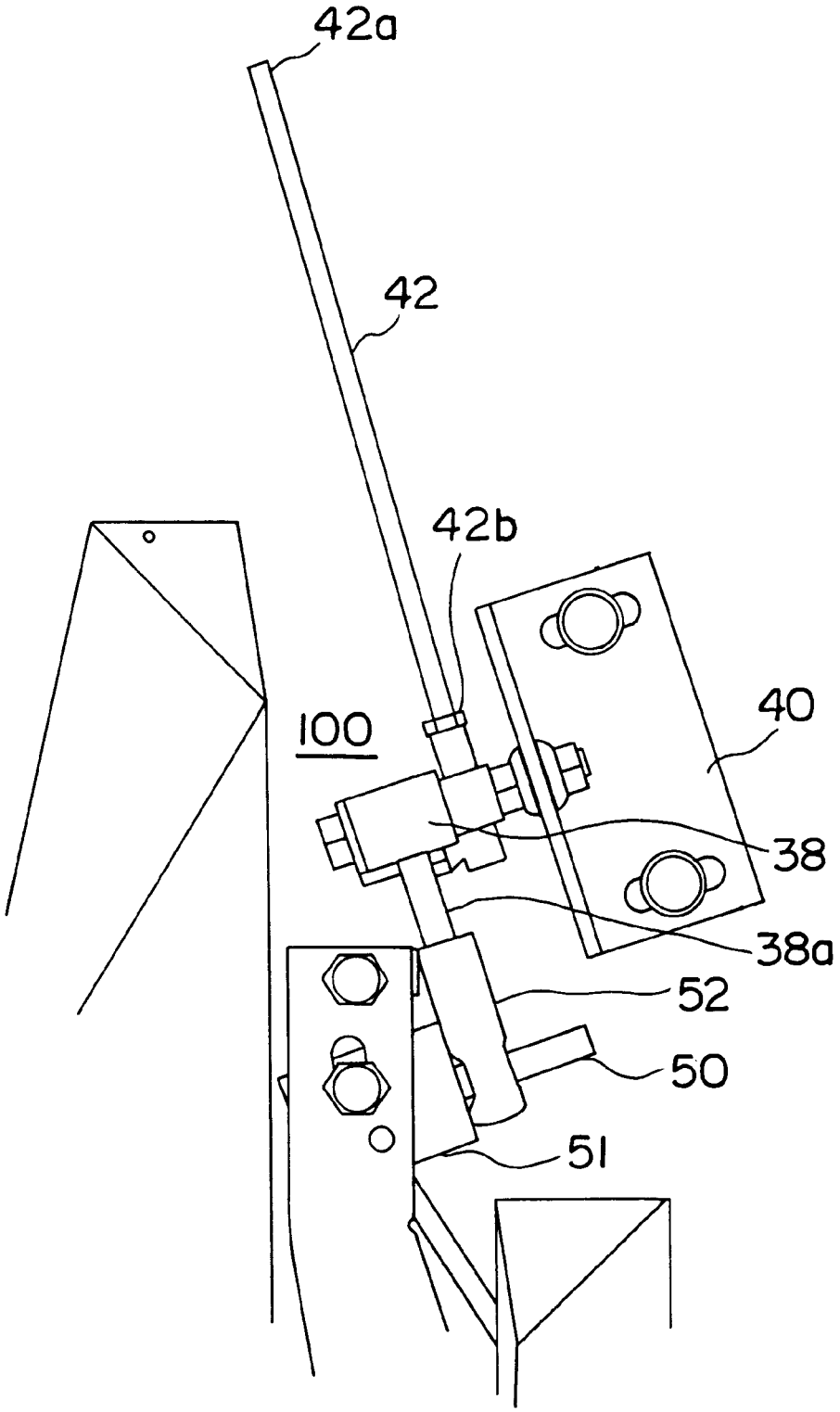
FIG. 11 is a front view of a crank and push rod assembly.

A preferred crank and push rod assembly 100 is outlined by dashed lines in FIG. 1, and is shown a greater detail in FIGS. 8–13. Referring to FIG. 11, the crank and push rod assembly is composed of a crank body 38. The crank body 38 is mounted to the car door 10 with a bracket 40 and is rotatable about its cylindrical axis, which is parallel to a plane formed by the surface of the car door. (See dashed lines and arrows in FIGS. 12 and 13).

As shown in FIGS. 9 and 11, the crank body 38 has a first arm 38*a* that extends perpendicular from the crank body 38. The first arm 38*a* is generally cylindrically shaped, and extends from the crank body 38 in a manner such that its cylindrical axis is perpendicular to the cylindrical axis of the crank. The crank further comprises a cylindrically shaped slide bushing 52 (see FIGS. 10 and 11) having a cylindrical axis concentric with the cylindrical axis of the first arm 38*a*. The slide bushing 52 is free to slide toward and away from the crank 38 along the first arm 38*a* and is free to rotate about its cylindrical axis. As is depicted in FIG. 10, the slide bushing 52 has an elongated slot 53.

A plate 51 is attached at one end to the actuating mechanism 32 (See FIG. 13) and cantilevers towards and away from the surface of door 10*a* in unison with the actuating mechanism 32. The plate 51 has an actuator finger 50 (See FIG. 8) that extends through the elongate slot 53 of slide bushing 52 forming a generally right angle with the slide bushing when viewed from the front (See FIG. 11). When the actuator mechanism 32 moves toward and away from the car door 10 about its vertical axis of rotation, the actuating finger 50 cause the crank 38 to rotate about its cylindrical axis.

Figure 13:
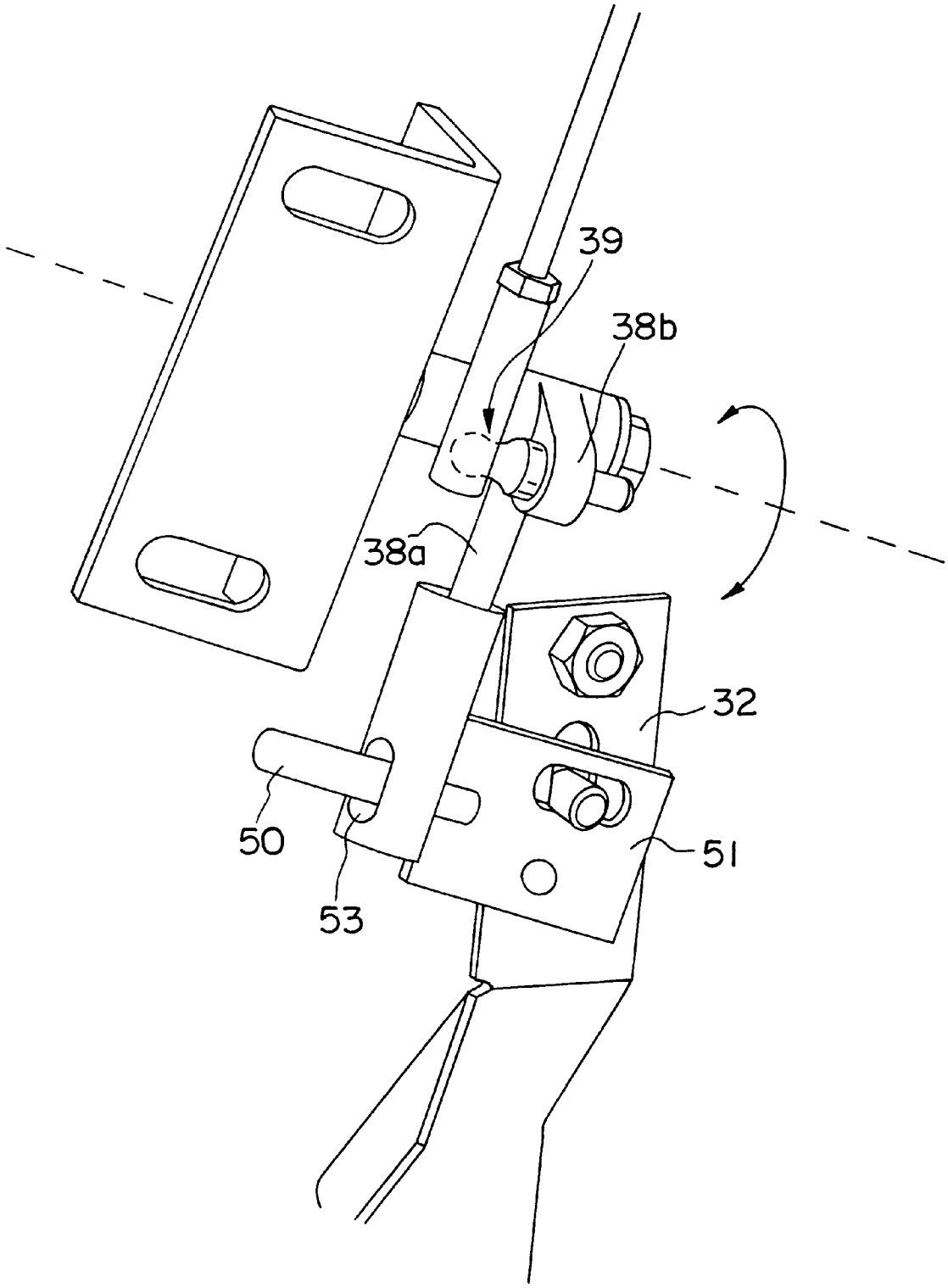
FIG. 13 is a rear perspective view of the crank and push rod assembly.

As shown in FIGS. 9 and 13, the crank 38 has a second arm 38*b*, generally perpendicular to the first arm 38*a*. The lower end of the push rod 42 is attached to the second arm 38*b* by a ball joint assembly 39. (See FIG. 13). An upper end of the push rod 42 is attached to hook member 30 (see FIG. 1), thus coupling the hook member 30 to the crank and push rod assembly 100 so that when the crank 38 rotates, the hook 30 also rotates and vice-versa. The push rod 42 of the crank and push rod assembly 100, may be angled to the left of vertical by up to 45 degrees.

Figure 12:
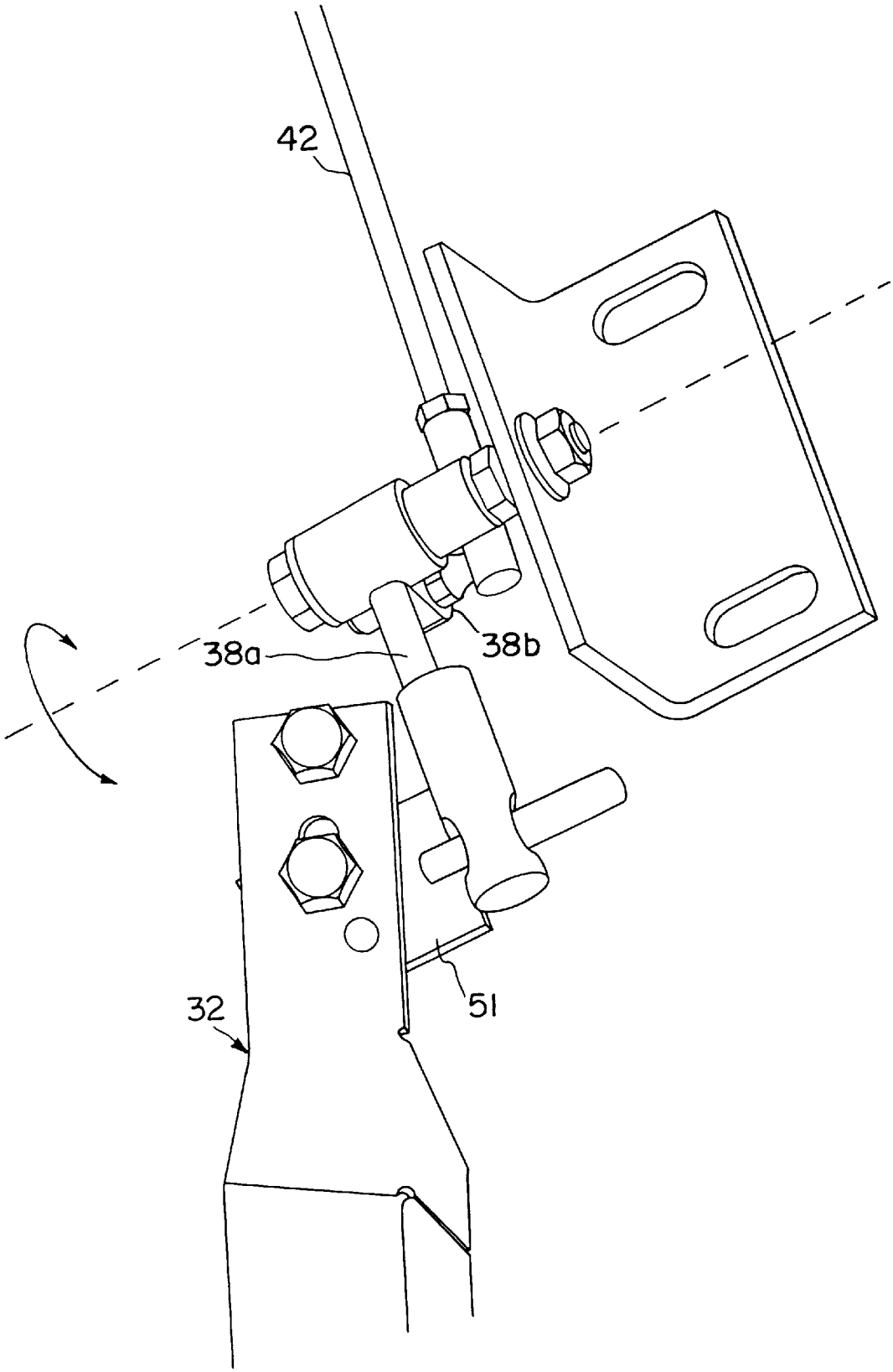
FIG. 12 is a front perspective view of the crank and push rod assembly.

The crank and push rod assembly 100 operates in conjunction with hook 30 and actuating mechanism 32 as follows. Referring to FIG. 1, if the hook member 30 is rotated counterclockwise with a sufficient force to overcome the bias created by the leaf springs 34, then the push rod 42 moves generally upward. Referring now to FIG. 12, the upward movement of push rod 42 causes the crank assembly 38 to rotate and consequently causes the first arm 38*a*, the plate 51, and the actuating mechanism 32 to move toward the car door 10 against the force of the leaf springs 34. When the hook member 30 rotates clockwise, the push rod 42 moves in a generally downward position. This rotates the crank body 38 in an opposite direction and consequently causes the first arm 38*a*, plate 51, and the actuating mechanism 32 to move away from the car door with the force of the leaf springs 34.

The restrictor appartus of the invention has three positions of operation: (i) a closed position when the elevator car door is closed; (ii) an unlocked position when the car is at a landing and the door is permitted to open; and (iii) a locked position when the car is not at a landing and the door is not permitted to open.

Figure 5:
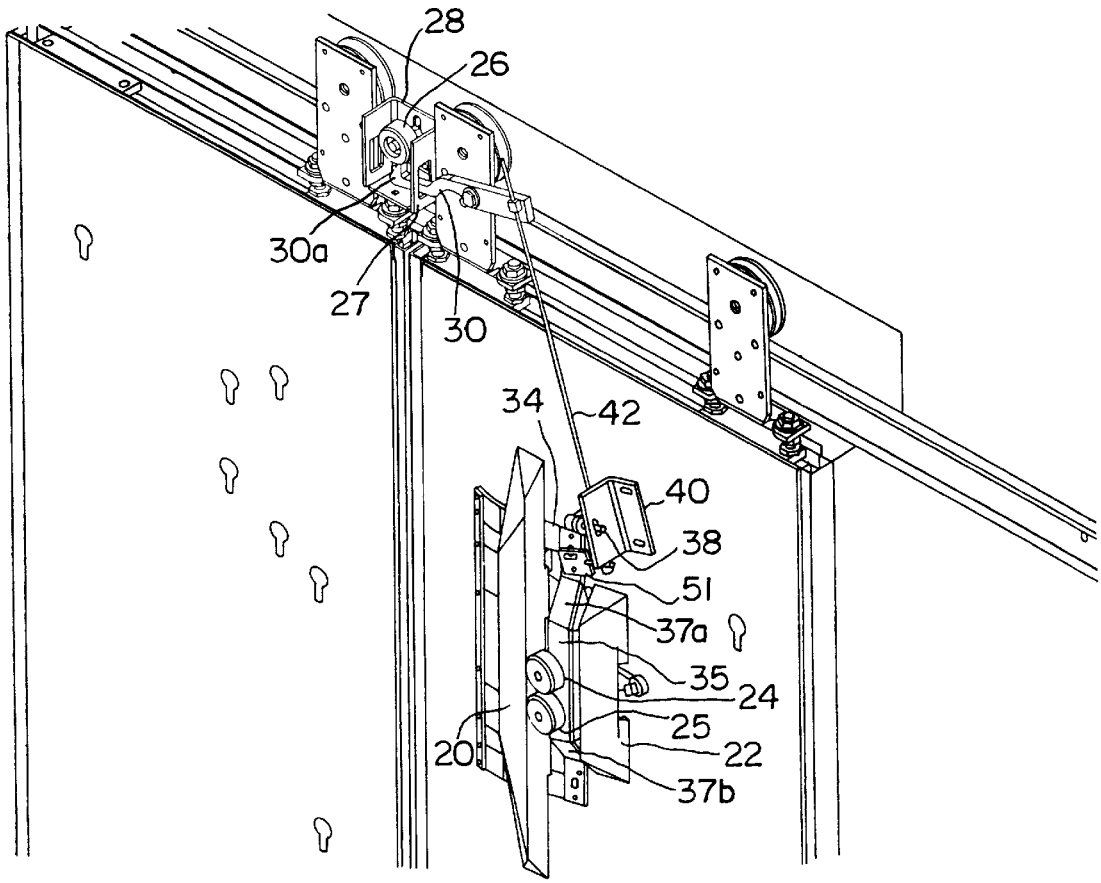
FIG. 5 is a perspective view of the door restrictor apparatus, with the door in the closed position and the elevator car at a landing and inside the hatch door zone.
Figure 6:
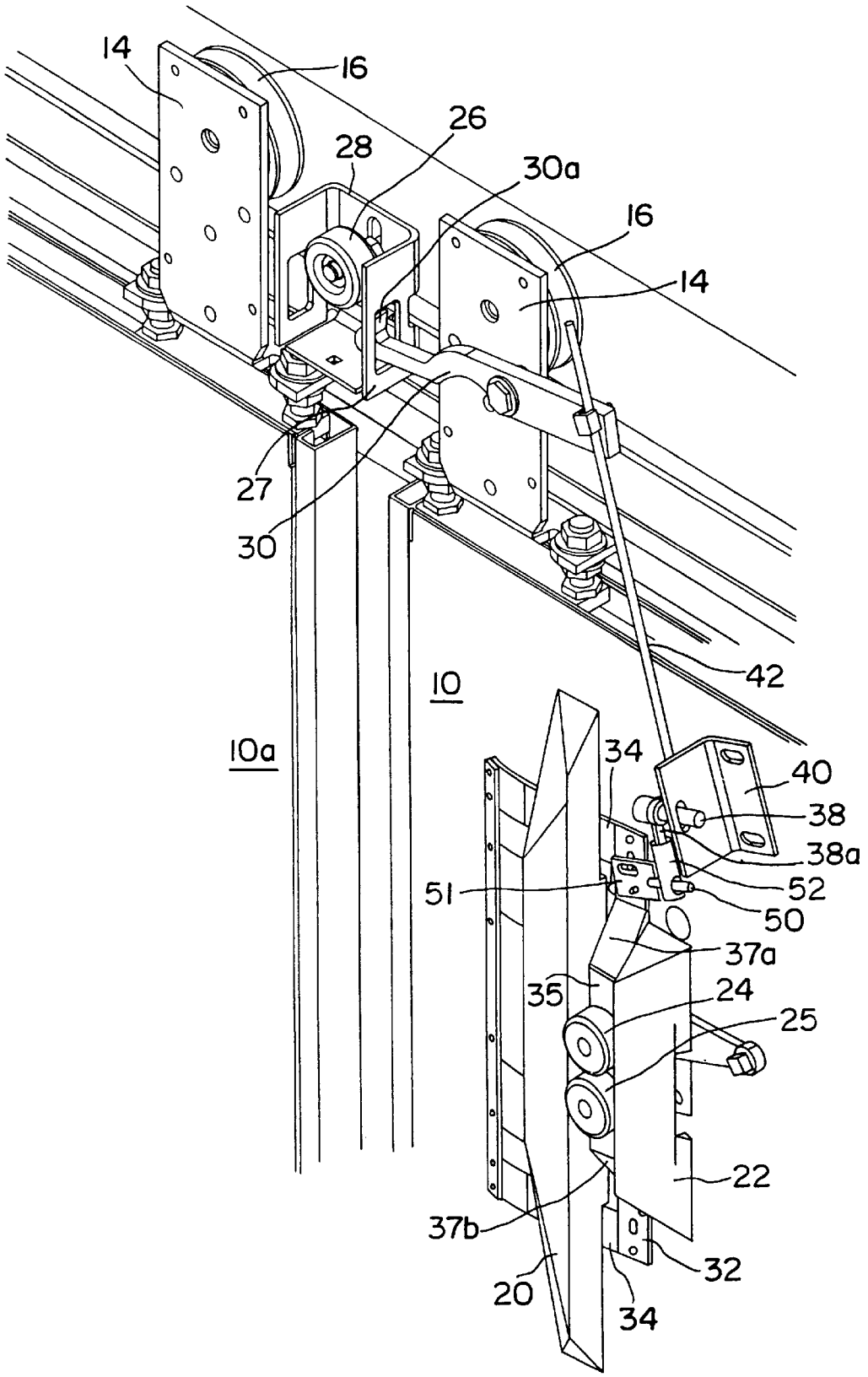
FIG. 6 is a perspective view of the door restrictor apparatus in the unlocked position with the car at a landing and the cars doors partially opened.
Figure 7:
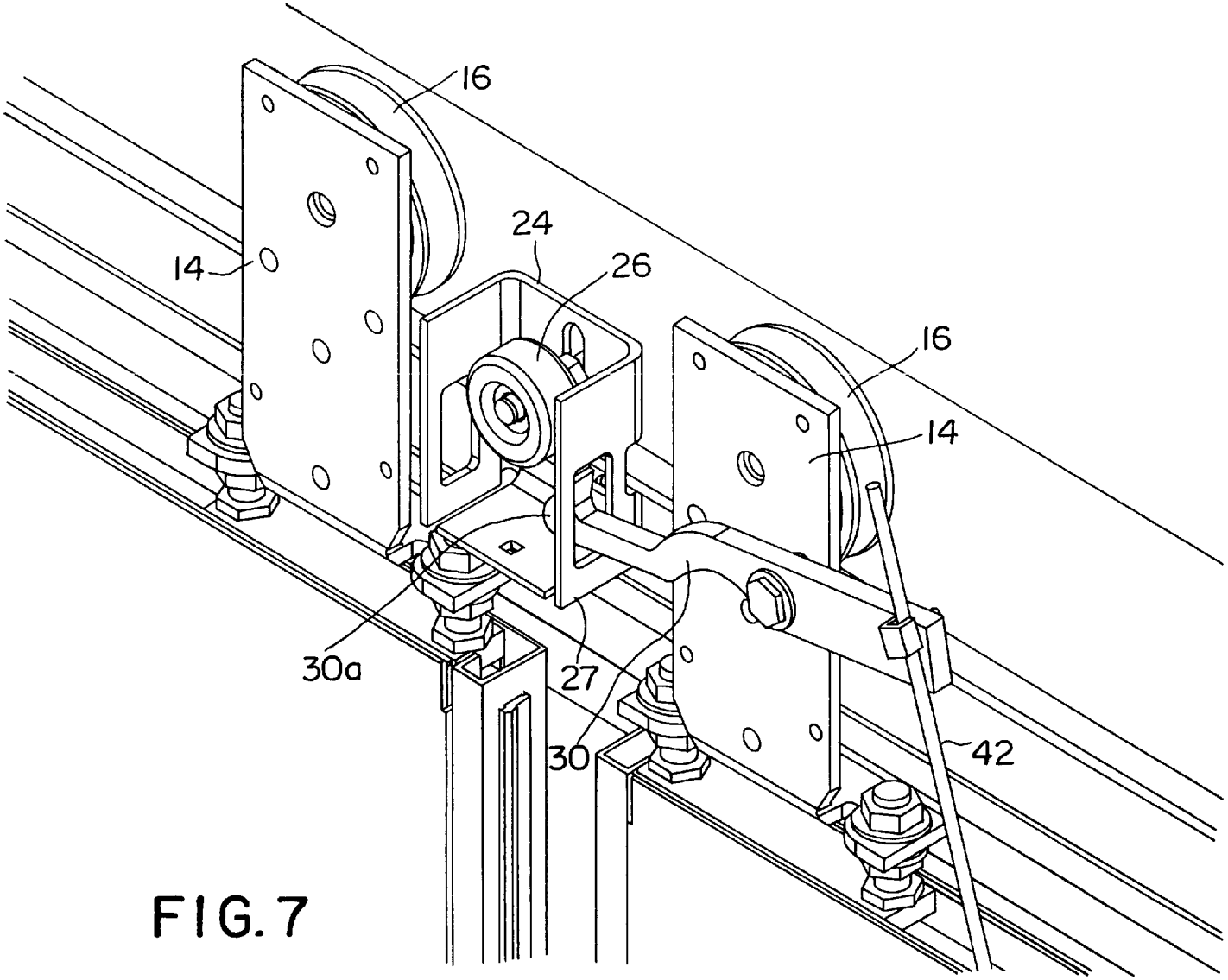
FIG. 7 is an enlarged perspective view of the upper portion of the door restrictor apparatus of FIG. 6 showing the car doors partially opened and the apparatus in the unlocked position.
Figure 8:
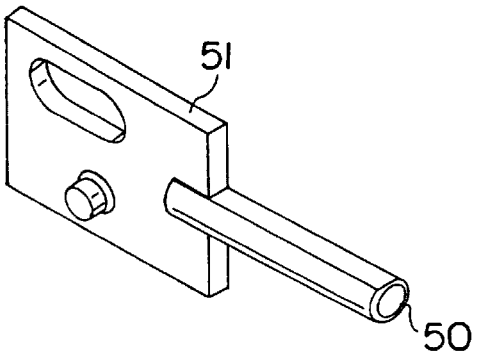
FIG. 8 shows an enlarged perspective view of an actuating finger member denoted by elements 50 and 51 depicted in the figures.

In operation, referring to FIGS. 1, 2 and 5, when the car door and the restrictor apparatus are in the closed position, the beak 30*a* of the hook member 30 engages the center of the hook roller 26, which rotates the hook member 30 in a counterclockwise direction to a first position and consequently moves the actuating mechanism 32 toward the surface of door 10*a* to a corresponding first position. When the restrictor apparatus is in the closed position and the actuating mechanism is in the corresponding first position, the actuating surface 35 and ramps 37*a* and 37*b* will not come into contact with hatchway door rollers 24 and 25 as the elevator car moves from floor to floor (See FIGS. 2 and 5). While the preferred embodiment uses a hook roller 26 to maintain the restrictor apparatus in the closed position, it is envisioned that a fixed member may be used in place of a hook roller 26.

Referring to FIGS. 3–7, as the door 10 opens, the beak 30*a* rolls off the hook roller 26 and the bias in the system created by leaf springs 34 causes the hook member 30 to begin rotating clockwise. As the hook member 30 rotates clockwise, the push rod 42 moves generally downward, rotating the crank 38 and consequently allowing the actuating mechanism 32 to move away from the car door with the force of leaf spring 34. The restrictor apparatus will then move into an unlocked position or locked position, depending on whether the car is at a landing.

In the unlocked position (depicted in FIGS. 6 and 7), when the car is at a landing area and the doors begin to open, as the beak 30*a* rolls off the hook roller 26, the actuating surface 35 will contact the hatchway rollers 24, 25 and thus limit the distance that the leaf spring 34 will bias the actuating mechanism 32 away from the car door 10. While in one embodiment the actuating surface contacts hatchway rollers, it is envisioned that other protruding members fixed to the hatchway door or any stationary surface within an elevator system may be used to engage the actuating surface 35. The limitation in the movement of actuating surface 35 limits the clockwise rotation of the hook member 30 causing the hook member 30 to stop at a second position when the actuating surface 35 reaches a corresponding second position (i.e., the position of actuating surface 35 when it hits the hatchway rollers 24, 25). The push rod 42 is adjusted so that when the actuating surface 35 contacts the hatchway rollers 24, 25 and the hook stops at the second position, the beak 30*a* will pass through the lug 27 as the door 10 is opened.

In the locked position (depicted in FIGS. 3 and 4) when the car is not at a landing area, as the beak 30*a* rolls off the hook roller 26, the leaf spring 34 biases the actuating mechanism 32 away from the car door 10 and, because the actuating mechanism 32 is in a position where it will not contact hatchway rollers 24, 25, the actuating mechanism 32 is free to move away from the car door. Thus, the hook member 30 continues to rotate clockwise to a third position where the beak 30*a* engages the lug, and thus prevents the car door from opening any farther.

In the preferred embodiment, when the elevator doors 10, 10*a* are closed, the push rod 42 is adjusted so that the distance between the actuating mechanism 32 and the hatchway rollers 24, 25 is about 0.25 inch and thus the actuating mechanism 32 does not contact the hatchway rollers 24, 25 as the car moves between floors. (See FIG. 5). However, when the car is at rest on a landing and an attempt to open the door is made, the actuating mechanism contacts the hatchway rollers 24, 25 before the hook member 30 rotates to a position where the beak 30*a* will engage the locking lug 27 and thus allows the door to open. (See FIGS. 6 and 7).

The foregoing represents a preferred embodiments of the invention. Variations and modifications will be apparent to persons skilled in the art, without departing from the inventive concepts disclosed herein. For example, while the invention has been described in a door system using center-opening doors, it is equally applicable to a single door or to telescoping door arrangements. Also, while it is convenient to utilize the conventional hatchway rollers to engage the actuating surface, if desired some other protruding member can be mounted on the hatchway doors and used for such purpose. Such alternative would provide greater freedom in the choice of where to locate the actuating mechanism of the interlock mechanism. Also, while the connecting rod is shown as being coupled to the hook member on the opposite end of the hook, the rod (or other suitable coupling member, such as a cable), could be coupled to the hook member on the same side of the pivot 31 as the hook itself In addition, while an example is given of a hook member which is positioned below the roller, the roller could be located above the roller, in which case the coupling mechanism between the actuating mechanism and the hook member would be arranged to move the hook upwardly when the actuating mechanism is pushed towards the car door. Finally, while the roller axis is shown as being horizontal, it is possible to orient such axis vertically, or at some angle between horizontal and vertical, provided that the hook member's pivot axis is parallel to the axis of the roller. All such modifications and variations are intended to be within the skill of the art, as defined in the following claims.

What is claimed is:

1. An elevator door restrictor apparatus for preventing a sliding door on an elevator car from opening unintentionally when the car is not at a landing area, the door restrictor apparatus comprising:

a lug mounted on the car;

an actuating mechanism disposed on a surface of the door, the actuating mechanism having an actuating surface that moves toward and away from the surface of the door;

a pivotable hook mounted on the door, the hook having an axis of rotation that is perpendicular to the direction of the movement of the door, the hook having a beak end for alternatively passing by or locking against the lug as the car door opens;

a crank and push rod assembly disposed on the surface of the door and connected to the pivotable hook and the actuating mechanism, the crank and push rod assembly coupling the rotation of the pivotable hook to the movement of the actuating surface; and means for biasing the restrictor apparatus to urge the actuating surface to move away from the surface of the door and to urge the pivotable hook to rotate in a first direction;

the restrictor apparatus having (i) a closed position wherein the hook is at a first position and the actuating surface is at a corresponding first position when the sliding door is closed; (ii) an unlocked position wherein the hook is at a second position where the beak will pass by the lug as the door opens when the car is at a landing and wherein the actuating surface is at a corresponding second position; and (iii) a locked position wherein the hook is at a third position where the beak will engage and lock against the lug as the sliding door opens when the car is not at a landing area and wherein the actuating surface is at a corresponding third position.

2. An elevator door restrictor apparatus according to claim 1, further comprising a fixed member for engaging the beak end of the hook, the fixed member mounted on the car; and wherein the means for biasing the restrictor apparatus comprises at least one spring mounted to the actuating mechanism.

3. An elevator door restrictor apparatus according to claim 1, further comprising a hook roller mounted on the car, the hook roller having an axis of rotation parallel to the axis of rotation of the hook, the hook roller contacting the beak end when the hook is in the first position; and wherein the means for biasing the restrictor apparatus comprises at least one spring mounted to the actuating mechanism.

4. The elevator door restrictor according to claim 1, wherein the crank and push rod assembly comprises:

a crank body capable of rotating about a first axis;

a first arm extending from the crank body at a generally right angle with the first axis;

a second arm extending from the crank body at a generally right angle with the first axis;

a slide bushing seated on the first arm having a cylindrical bore with a cylindrical axis and capable of rotating about the first arm and sliding along the first arm in a direction toward and away from the crank body, the slide bushing having an elongated slot bored perpendicularly to the cylindrical axis, the slot having a length dimension parallel to the cylindrical axis and a width dimension perpendicular to the cylindrical axis that is shorter then the length dimension.

5. An elevator system and door restrictor apparatus for preventing a sliding door on an elevator car from opening unintentionally when the car is not at a landing area, the door restrictor apparatus comprising:

an elevator shaft;

a plurality of landings;

at least one hatchway door at each landing, the hatchway door having one or more hatchway door rollers disposed on the hatchway door;

an elevator car having at least one sliding door;

a lug mounted on the car;

an actuating mechanism disposed on a surface of the door, the actuating mechanism having an actuating surface that moves toward and away from the surface of the door;

a pivotable hook mounted on the door, the hook having an axis of rotation that is perpendicular to the direction of the movement of the door, the hook having a beak end for alternatively passing by or locking against the lug as the car door opens;

a crank and push rod assembly disposed on the surface of the door and connected to the pivotable hook and the actuating mechanism, the crank and push rod assembly coupling the rotation of the pivotable hook to the movement of the actuating surface; and means for biasing the restrictor apparatus to urge the actuating surface to move away from the surface of the door and to urge the pivotable hook to rotate in a first direction;

the restrictor apparatus having (i) a closed position wherein the hook is at a first position and the actuating surface is at a corresponding first position when the sliding door is closed; (ii) an unlocked position wherein the hook is at a second position where the beak will pass by the lug as the sliding door opens when the car is at a landing and wherein the actuating surface is at a corresponding second position; and (iii) a locked position wherein the hook is at a third position where the beak will engage and lock against the lug as the sliding door opens when the car is not at a landing and wherein the actuating surface is at a corresponding third position.

6. An elevator system according to claim 5, further comprising a fixed member for engaging the beak end of the hook, the fixed member mounted on the car; and wherein the means for biasing the restrictor apparatus comprises at least one spring mounted to the actuating mechanism.

7. An elevator system as recited in claim 5, further comprising a hook roller mounted on the car, the hook roller having an axis of rotation parallel to the axis of rotation of the hook, the hook roller contacting the beak end when the hook is in the first position; and wherein the means for biasing the restrictor apparatus comprises at least one spring mounted to the actuating mechanism.

8. An elevator system as recited in claim 5, wherein when elevator is at a landing and the sliding door begins to open, the hook rotates in the first direction from the first position and stops rotating at the second position when the hatchway rollers contact the actuating surface at which the actuating surface is at the corresponding second position.

9. An elevator system as recited in claim 5, wherein when the elevator is not at a landing and the sliding door begins to open, the hook rotates in the first direction from the first position and stops rotating at the third position when the beak end engages and locks against the lug and the actuating surface is at the corresponding third position.

10. A crank for use with an elevator door restrictor that converts motion in one direction into motion in a second direction comprising:

a crank body capable of rotating about a first axis;

a first arm extending from the crank body at a generally right angle with the first axis;

a second arm extending from the crank body at a generally right angle with the first axis;

a slide bushing seated on the first arm having a cylindrical bore with a cylindrical axis and capable of rotating about the first arm and sliding along the first arm in a direction toward and away from the crank body, the slide bushing having an elongated slot bored perpendicularly to the cylindrical axis, the slot having a length dimension parallel to the cylindrical axis and a width dimension perpendicular to the cylindrical axis that is shorter then the length dimension.

* * * * *